United States Patent [19]

Berton et al.

[11] 4,116,863

[45] Sep. 26, 1978

[54] METHOD OF DECONTAMINATION OF RADIOACTIVE EFFLUENTS

[75] Inventors: Yves Berton, Le Puy Ste Reparade; Pierre Chauvet, Manosque, both of France

[73] Assignee: Commissariat a l'Energie Atomique, Paris, France

[21] Appl. No.: 780,498

[22] Filed: Mar. 23, 1977

[30] Foreign Application Priority Data

Mar. 31, 1976 [FR] France ..... 76 09307
Jan. 27, 1977 [FR] France ..... 77 02285

[51] Int. Cl.[2] ..... G21F 9/06
[52] U.S. Cl. ..... 252/301.1 W; 423/2
[58] Field of Search ..... 252/301.1 W; 423/2, 423/22; 210/53, 28

[56] References Cited

U.S. PATENT DOCUMENTS 3,330,771 7/1967 Komatsu et al. ..... 252/301.1 W

FOREIGN PATENT DOCUMENTS 1,312,852 4/1973 United Kingdom.
1,358,139 6/1974 United Kingdom.

OTHER PUBLICATIONS

Glueckauf, E., Ed., *Atomic Energy Wastes*, Interscience Publishers, Inc., New York, 1961, pp. 211-216.

*Primary Examiner*—Benjamin R. Padgett
*Assistant Examiner*—Deborah L. Kyle
*Attorney, Agent, or Firm*—McNenny, Pearne, Gordon, Gail, Dickinson & Schiller

[57] ABSTRACT

In a method of decontamination of a radioactive effluent from at least ruthenium, a reduction of the effluent is carried out by adding hydrazine or a hydrazine salt. Precipitates having absorbent and/or coprecipitant properties with respect to radioactive elements are formed in the effluent without any intermediate separation of phases, a cobalt sulphide precipitate being formed for the removal of ruthenium.

21 Claims, 7 Drawing Figures

Figure 1:
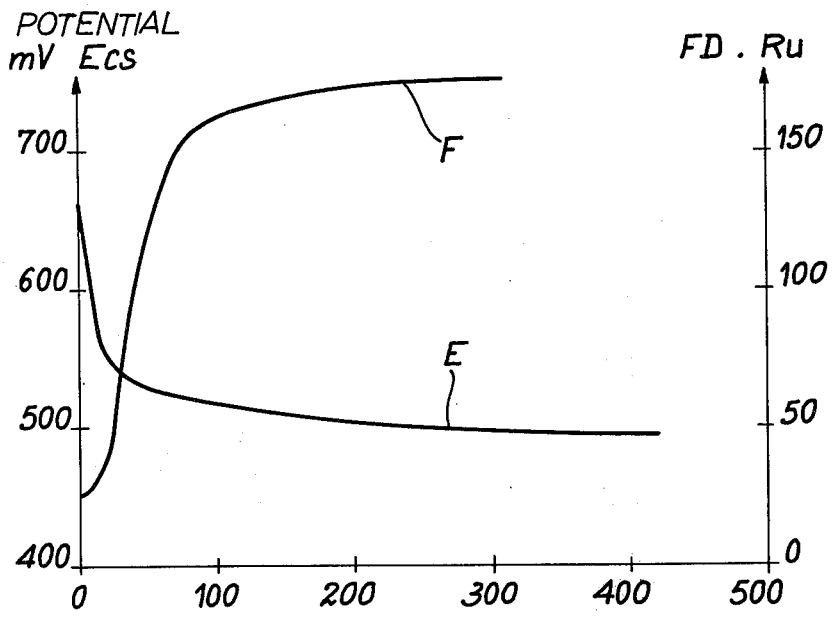

FD $10^2$
5
4
3
2
10
5
4
3
2
9 ($^{125}$Sb)
11 ($\gamma_{TOTAL}$)
10 ($^{106}$Ru)
pH = 8,5
IONS Zr mg/ℓ
100
200
300
400

FD $10^2$
5
4
3
2
10
5
4
3
2
12 ($^{125}$Sb)
14 ($\gamma_{total}$)
13 ($^{106}$Ru)
Zr = 300 mg/ℓ
PH
2
3
4
5
6
7
8
9
10

METHOD OF DECONTAMINATION OF RADIOACTIVE EFFLUENTS

This invention relates to a method for the decontamination of radioactive effluents and more particularly for satisfactory decontamination by removal of at least ruthenium from radioactive effluents derived from the processing of irradiated fuels.

It is recalled that decontamination of radioactive effluents is usually performed by chemical precipitation of different compounds without intermediate separation of phases, removal of the radioactive elements contained in the effluents considered being ensured by the absorbent and/or coprecipitant function of these compounds.

Thus, in accordance with a known method, decontamination of an effluent derived from reprocessing of irradiated fuels and containing in particular strontium, caesium, ruthenium and antimony is carried out by forming in the effluent precipitates of barium sulphate (strontium decontamination), nickel ferrocyanide (caesium decontamination) and ferrous sulphide (ruthenium decontamination).

In accordance with this method, the precipitates are obtained by successively adding to the effluent sulphuric acid, a preformed precipitate of nickel ferrocyanide, ammonium sulphide, ferrous iron and barium nitrate. It is worthy of note that, in respect of a final pH of the order of 8.5, the other radioactive elements which are also present in the effluent to be processed and especially cerium, zirconium, niobium and the $\alpha$-emitters are entrained by the precipitates which are formed.

However, this method has a disadvantage in that it does not permit satisfactory entrainment of the ruthenium contained in the effluent.

The precise aim of the present invetion is to provide a method of decontamination of radioactive effluents containing at least ruthenium which overcomes the disadvantage just mentioned, especially insofar as it permits not only good decontamination of the effluent from different radioactive elements but also satisfactory removal of the ruthenium contained in the effluent.

The method of decontamination of a radioactive effluent containing at least ruthenium in accordance with the invention essentially consists in forming a precipitate of cobalt sulphide in the effluent to be treated.

Thus, when the method in accordance with the invention is carried into effect for the decontamination of an effluent which results from reprocessing of fuels, that is to say which contains especially strontium, caesium, ruthenium and antimony, precipitates of nickel ferrocyanide, of cobalt sulphide and of barium sulphate are formed in the effluent and the sludges thus obtained are then separated. In the event that the treatment is carried out in a tank made of material which does not afford resistance to corrosion by the sulphide ions in an acid medium, the above-mentioned precipitates are formed by successively adding to the effluent sulphuric acid, nickel ferrocyanide, sodium hydroxide, ammonium sulphide, cobalt sulphate or nitrate and barium nitrate.

A preferential mode of execution of the method in accordance with the invention for decontamination of an effluent of the type mentioned above consists in adding the following constituents to the effluent: sulphuric acid in a proportion of 3,000 to 18,000 mg/l of sulphate ions, nickel ferrocyanide in the form of a suspension of preformed colloidal precipitate corresponding to doses of 300 mg/l of ferrocyanide ions and 100 mg/l of nickel ions, a quantity of sodium hydroxide which makes it possible to adjust the pH of the effluent to a value of the order of 8.5, ammonium sulphide in a proportion of 200 mg/l of sulphide ions, cobalt nitrate or sulphate in a proportion of 250 mg/l of cobalt ions and barium nitrate in a proportion of 1,500 to 2,000 mg/l of barium ions.

In accordance with a first preferential arrangement of the invention, it is possible to improve the entrainment of the ruthenium contained in the effluent even further in order to achieve a greater reduction in residual activity of the effluent after treatment, this residual activity being mostly due to the ruthenium in a proportion of 80 to 90%.

In accordance with this preferential arrangement, the method contemplated by the invention essentially consists in subjecting the effluent to be treated to a reduction process prior to formation of the precipitate of cobalt sulphide, said reduction being preferably carried out by addition of hydrazine or of a hydrazine salt to the effluent.

It can be noted that the preliminary reduction of the effluent by hydrazine or a hydrazine salt makes it possible to increase the entrainment of the ruthenium to an even greater extent and a further advantage of the reducing agent lies in the fact that it does not produce sludges.

When the method of the invention in accordance with the arrangement described above is applied to the decontamination of a radioactive effluent which results from the treatment of irradiated fuels, namely which contains in particular strontium, caesium, ruthenium and antimony, there are carried out successively the operations which consist of reduction of the effluent by hydrazine or a hydrazine salt, the formation of a precipitate of nickel ferrocyanide, cobalt sulphide and barium sulphate followed by separation of the sludges thus obtained.

In a process of this type, the precipitates are formed by successively adding to the effluent sulphuric acid, hydrazine or a hydrazine salt, nickel ferrocyanide, sodium hydroxide, ammonium sulphide, cobalt sulphate or nitrate and barium nitrate. These reagents are added to the effluent in the same proportions as those mentioned earlier.

It is preferable in this mode of operation to add 50 to 500 mg/l of hydrazine or hydrazine salt to the effluent.

In accordance with a second preferential arrangement of the invention which is more particularly directed to the decontamination of radioactive effluents containing at least ruthenium and antimony, it is possible to ensure satisfactory removal of the antimony contained in the effluent and also to achieve a further improvement in ruthenium decontamination of the effluent.

In accordance with this second arrangement which may or may not be associated with the first arrangement relating to the reduction pretreatment, the method in accordance with the invention essentially consists in additionally forming in the effluent to be treated a precipitate of a hydroxide of an element of column IV*a* of the periodic table which is preferably selected from the group comprising titanium, thorium and zirconium and in separating-out the sludges thus obtained.

When the method of the invention in accordance with the second arrangement mentioned above is applied to decontamination of a radioactive effluent which results from the treatment of irradiated fuels, namely which contains in particular strontium, caesium, ruthenium and antimony, precipitates of a hydroxide of an element of group IV*a* of the periodic table, nickel ferrocyanide, cobalt sulphide and barium sulphate are formed in said effluent if necessary after preliminary reduction of the effluent in accordance with the first preferential arrangement of the invention and the sludges thus obtained are then separated-out. In more precise terms, said precipitates are formed by successively adding to the effluent sulphuric acid, a salt of an element of group IV*a* of the periodic table, nickel ferrocyanide, sodium hydroxide, ammonium sulphide, cobalt sulphate or nitrate and barium nitrate.

The sulphuric acid, nickel ferrocyanide, sodium hydroxide, ammonium sulphide, cobalt nitrate or sulphate and barium nitrate are added to the effluent in the order and the proportions given earlier in the method of the invention which may or may not be in accordance with the first preferential arrangement aforesaid.

The preferential quantities of the salt of an element of group IV*a* of the periodic table will be given later in the description.

In accordance with the invention, the precipitation of a hydroxide of titanium is carried out by adding to the effluent a titanium salt in the form of an aqueous acid solution of titanium sulphate.

There is obtained "in situ" a barium sulphate precipitate which absorbs the strontium contained in the effluent, a titanium hydroxide precipitate which absorbs the antimony and also a proportion of the order of 50% of the ruthenium contained in the effluent, a nickel ferrocyanide precipitate which absorbs the caesium contained in the effluent and a cobalt sulphide precipitate which absorbs the remaining ruthenium in the effluent.

The acid solution of titanium sulphate employed is a solution which corresponds to the formula $(SO_4)_2$ Ti, $H_2SO_4$, n $H_2O$.

In the method according to the invention, the aqueous acid solution of titanium sulphate employed is preferably added in a quantity such as to have approximately 300 mg of titanium ions per liter of effluent. Moreover, the final pH value of the effluent is preferably within the range of 6 to 8.

In accordance with the invention, the precipitation of a zirconium hydroxide is carried out by adding to the effuent a zirconium salt in the form of a zirconyl nitrate solution.

There is thus obtained "in situ" a barium sulphate precipitate which absorbs the strontium contained in the effluent, a zirconium hydroxide precipitate which absorbs the antimony and also approximately 50% of the ruthenium contained in the effluent, a nickel ferrocyanide precipitate which absorbs the caesium contained in the effluent and a cobalt sulphide precipitate which absorbs the remaining ruthenium in the effluent.

The zirconyl nitrate solution is preferably added in a quantity such as to have approximately 400 mg of zirconium ions per liter of effluent. Moreover, the final pH value of the effluent is preferably 6.5.

In accordance with the invention, the precipitation of thorium hydroxide is carried out by adding to the effluent a thorium salt in the form of a thorium nitrate solution.

By treating the same effluent as that which was treated with a zirconium salt as defined above with a thorium nitrate solution added in a quantity such as to have 300 mg of thorium ions per liter of treated effluent at a pH of 8.5, an antimony decontamination factor of 6 is accordingly obtained.

It is pointed out that, in the method according to the invention, the cobalt sulphide precipitate can be formed after having adjusted the pH of the effluent either to a value which is higher than 7 as in the modes of operation mentioned earlier when the treatment is carried out in tanks which are not capable of affording resistance to corrosion or to a value which is lower than 7 (preferably below 2); the formation of the precipitate at an acid pH value makes it possible to increase the ruthenium and antimony decontamination factor but entails the need for treatment tanks of suitable material.

Thus, in accordance with another mode of execution, the formation of the precipitates which may follow a preliminary reduction of the effluent is obtained by successively adding to the effluent to be treated sulphuric acid, possibly hydrazine or a hydrazine salt, possibly a salt of a hydroxide of group IV*a* of the periodic table, nickel ferrocyanide, ammonium sulphide, cobalt nitrate or sulphate, sodium hydroxide and barium nitrate, these being preferably added in the proportions mentioned in the foregoing.

It is worthy of note that the reduction of the effluent by hydrazine and the cobalt sulphide precipitation in an acid medium make it possible to obtain decontamination from antimony which can if necessary be completed by precipitation of a hydroxide of group IV*a* of the periodic table.

Figure 2:
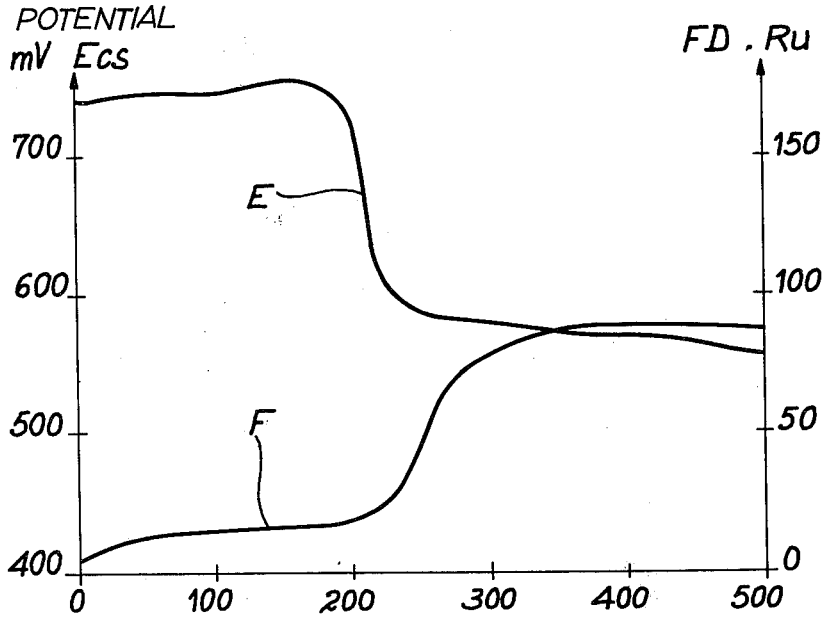
Figure 3:
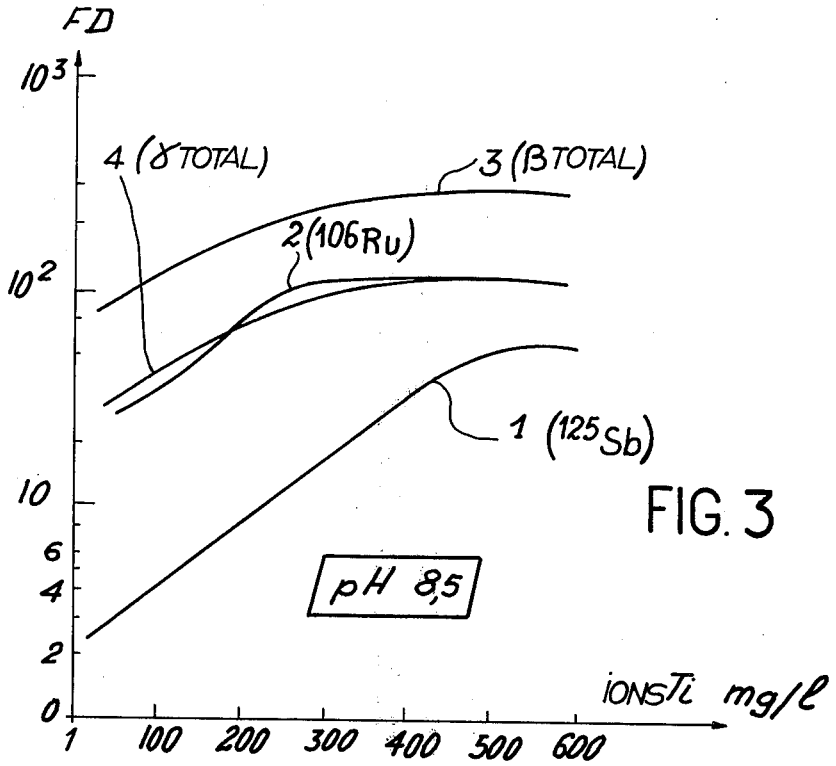
Figure 4:
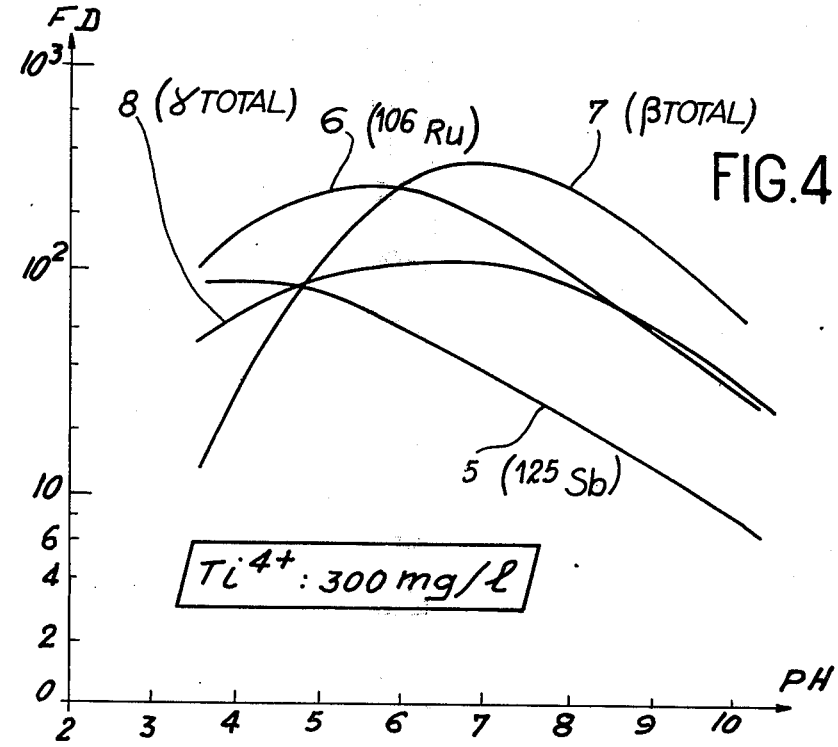
Figure 5:
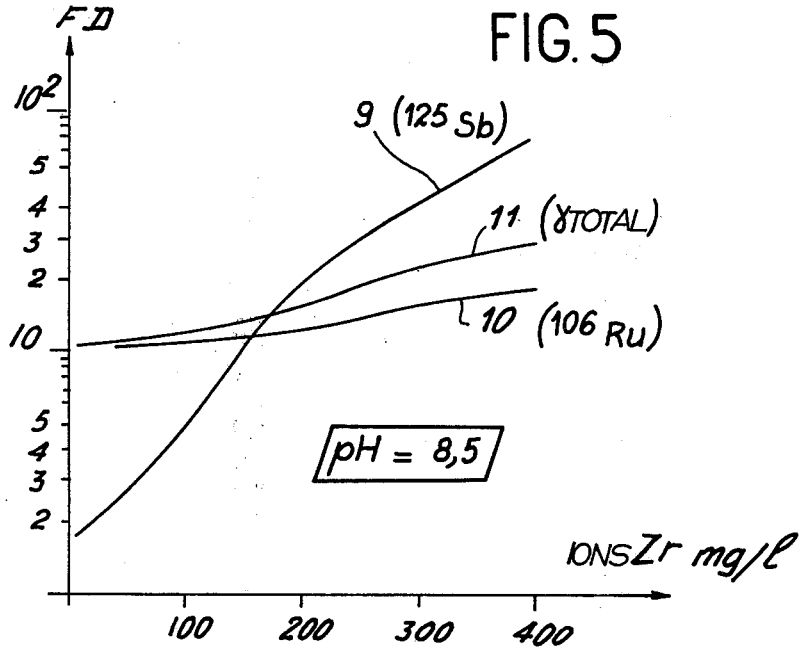
Figure 6:
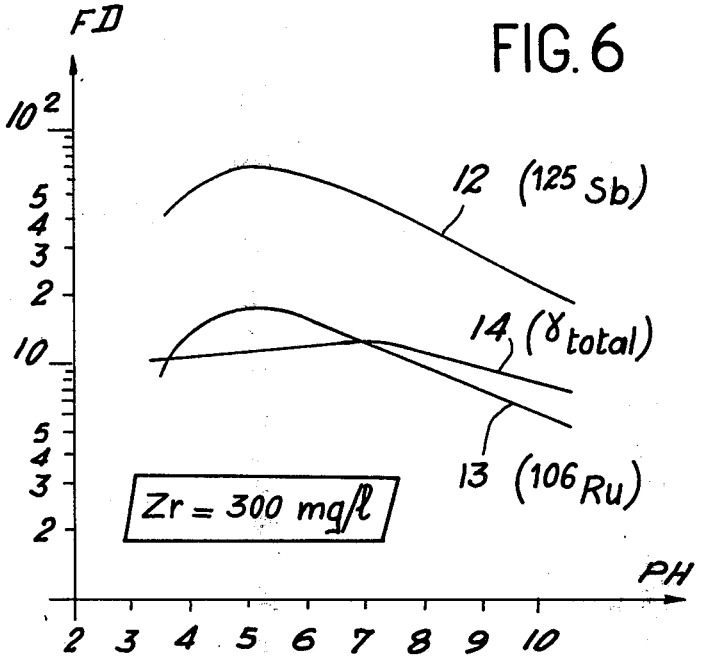

The choice of parameters of application of the method in accordance with the invention with at least one of the aforementioned preferential arrangements will become more readily apparatus from the following description, reference being made to the accompanying drawings, in which:

FIGS. 1 and 2 relate to an effluent of the aforementioned type which has previously been treated by means of the first preferential arrangement of the method in accordance with the invention (reduction of the effluent by hydrazine or a hydrazine salt). In these figures the curve E of variation in oxidation-reduction potential SCE of the effluent (saturated calomel electrode) has been plotted as a function of the quantity of hydrazine hydrate added to the effluent as expressed in mg/l of effluent and the curve F of variation of the ruthenium decontamination factor RuDF after treatment of the effluent in accordance with the mode of application of the method in accordance with the invention at a basic pH value has been plotted as a function of the quantity of hydrazine hydrate (in mg/l of effluent);

FIG. 3 relates to a mode of execution of the method in accordance with the invention by means of the second arrangement (precipitation of a hydroxide of an element of group IV*a* of the periodic table; in this figure the curves give the decontamination factor for antimony, for ruthenium, in total $\beta$ activity and in total $\gamma$ activity, as a function of the quantity of titanium ions in mg per liter of treated effluent;

FIG. 4 relates to a mode of execution of the method which is identical with the mode resulting in FIG. 3 and the curves give the decontamination factor for antimony, for ruthenium, in total $\beta$ activity and in total $\gamma$ activity as a function of the pH value of the effluent;

FIG. 5 again relates to a mode of execution of the method in accordance with the second arrangement recalled in the foregoing; in this figure the curves give the decontamination factor for antimony, for ruthenium, and in total $\gamma$ activity as a function of the quantity of zirconium ions in mg per liter of treated effluent;

FIG. 6 relates to a mode of execution of the method which is identical with the mode corresponding to the curves of FIG. 5; in this figure the curves give the decontamination factor for antimony, for ruthenium, in total $\gamma$ activity as a function of the pH value of the effluent.

The choice of the quantities of hydrazine or of hydrazine salt for the reduction of the effluent appears in FIGS. 1 and 2.

The effluent employed for plotting the curves of FIGS. 1 and 2 has the following characteristics:

| | | |
|---|---|---|
| - acidity (nitric acid) | : | 0.4 N |
| - concentration of $Al^{3+}$ | : | 30 mg/l |
| - concentration of $FE^{3+}$ | : | 11 mg/l |
| - total $\gamma$ radioactivity | : | 7.4 Ci/m$^3$ of which 2.5 Ci/m$^3$ are derived from ruthenium-106 |

It is pointed out that FIGS. 1 and 2 correspond respectively to an effluent of the type mentioned above and having a low concentration of nitrites, the concentration of nitrite ions being lower than 50 mg/l, and to an effluent as mentioned above and having a high nitrite concentration (corresponding to freshly produced effluent).

It is thus apparent from FIG. 1 that the oxidation-reduction potential falls rapidly from 670 mV SCE to 570 mV SCE then to a stable value of 500 mV and that the ruthenium decontamination factor is an increasing function of the quantity of hydrazine hydrate which is added to the effluent; the decontamination factor increases rapidly from 25 to 150, then stabilizes at a value above 150.

By adding a quantity of nitrite ions of the order of 300 mg/l to the effluent in order to simulate a freshly produced effluent, it is apparent from FIG. 2 that the curve E of variation in oxidation-reduction potential of the effluent exhibits a first level stage or plateau at 750 mV which corresponds to destruction of the nitrites, then a second plateau at 570 mV. At the same time, the curve F of variation of the ruthenium decontamination factor exhibits a first plateau in respect of a decontamination factor of the order of 15 and a second plateau in respect of a decontamination factor of the order of 90.

It may thus be noted that the addition of hydrazine hydrate causes the destruction of nitrites and possibly of certain nitrosyl-ruthenium nitrato and/or nitroso complexes, thus increasing the efficiency of the chemical treatment.

The choice of parameters relating to the treatment of an effluent with formation of a titanium hydroxide precipitate and a cobalt sulphide precipitate will become apparent from the following description which is given with reference to FIGS. 3 and 4. A study of these parameters has been made on the basis of an effluent having the following characteristics:

acidity: pH = 1.3;

SCE (saturated calomel electrode) oxidation-reduction potential = + 630 mV;

consumption in $KMnO_4$ < 20 mg/l;

dry extract after neutralization with sodium hydroxide: 34.70 g/l;

| elements analyzed in mg/l | | |
|---|---|---|
| | $Al^{3+}$ | 118 |
| | $Fe^{3+}$ | 33 |
| | $Ni^{2+}$ | 8 |
| | $Cu^{2+}$ | 3 |
| | $U^{6+}$ | 100 |
| radioactivity in Ci/m$^3$ | | |
| | $\alpha$ | 0.55 |
| | $\beta$ | 7.0 |
| | $\gamma$ $^{60}Co$ | 0.06 |
| | $\gamma$ $^{106}Ru$ | 2.49 |
| | $\gamma$ $^{125}Sb$ | 0.1 |
| | $\gamma$ $^{137}Cs$ | 0.03 |

The general study which is recorded in the accompanying Table I shows the influence of the different parameters (doses of titanium ions, final pH value, contacting times) on the results obtained when the effluent defined in the foregoing is treated by the method in accordance with the invention.

It is apparent from FIG. 3 that antimony decontamination is an increasing function of the quantities of titanium added to the effluent (a plateau is practically attained on curve 1 in respect of a dose of 460 mg of titanium ions per liter of effluent; the corresponding decontamination factor is in the vicinity of 50). The ruthenium decontamination is also improved by a factor within the range of 2 to 3 (curve 2). The overall decontamination for $\beta$ and $\gamma$-activity is improved by a factor of 3 and 4 (curves 3 and 4).

It can further be seen from FIG. 4 that the optimum pH zone is within the range of 3.5 to 5.5 in the case of antimony (curve 5; DF $\simeq$ 90) and that the optimum pH zone is between 4.5 and 6.5 in the case of ruthenium (curve 6; DF $\simeq$ 200). In practice, the maximum overall efficiency of the treatment (curves 7 and 8) is located in a pH zone within the range of 6 to 8.

In regard to the time of contact between the effluent to be treated and the aqueous acid solution of titanium sulphate, it is found that entrainment of antimony by the titanium hydroxide precipitate is very rapid, namely of the order of about 15 minutes. A contacting time of excessive length, for example longer than 60 minutes, can even result in slight salting-out.

The choice of parameters relating to treatment with a zirconium salt will be more readily understood from the following description which is given with reference to FIGS. 5 and 6. A study of these parameters has been made by considering an effluent having the following characteristics:

acidity: pH = 1.3;

SCE oxidation-reduction potential = + 630 mV;

consumption in $KMnO_4$ < 20 mg/l;

dry extract after neutralization with sodium hydroxide: 34.70 g/l;

| radioactivity in Ci/m$^3$ | | |
|---|---|---|
| | $\alpha$ | 0.55 |
| | $\beta$ | 7.0 |
| | $\gamma$ $^{60}CO$ | 0.06 |
| | $\gamma$ $^{106}Ru$ | 1.60 |
| | $\gamma$ $^{125}Sb$ | 0.09 |
| | $\gamma$ $^{137}Cs$ | 0.03 |

The study which has been recorded in Table II given hereunder shows the influence of the different parameters (doses of zirconium ions, final pH value) on the results obtained by treating the effluent defined in the foregoing by means of the method in accordance with the invention.

The influence of the quantities of zirconium employed is shown in FIG. 5.

As can be seen in FIG. 5, the antimony decontamination is an increasing function of the quantities of zirconium added to the effluent (curve 9); for reasons of treatment cost and volume of sludges, the quantity of zirconium added has purposely been limited to 400 mg per liter. The antimony decontamination factor is of the order of 80, namely an improvement in the decontamination by a factor of 50 in comparison with a treatment without zirconium. The ruthenium decontamination is improved by a factor of 1.8 (curve 10).

From FIG. 6, it is apparent that the optimum pH zone is within the range of 4 to 6.5 in the case of antimony (curve 12; DF ≃ 60 to 70 in respect of 300 mg per liter of zirconium) and that the optimum pH zone is within the range of 4 to 6.5 in the case of ruthenium (curve 13; DF ≃ 15). In practice, the maximum overall efficiency of the treatment (curve 14) is obtained at a pH of approximately 6.5.

If the results obtained with a titanium salt are compared with the results obtained with a zirconium salt, the following observations can be made:

in the case of antimony decontamination, the use of zirconium in the case of an alkaline pH is more effective than that of titanium: there is in fact obtained an antimony decontamination factor of 40, 30 and 20 with zirconium whereas an antimony decontamination factor of 17, 8 and 7 is obtained with titanium in the case of respective pH values of 8.5, 9.5 and 10.5;

in the case of ruthenium decontamination, the use of zirconium achieves an improvement by a factor of 1 to 1.8 whereas the use of titanium achieves an improvement by a factor of 1 to 4.

It accordingly follows from the foregoing that the precipitation of a zirconium hydroxide or of a titanium hydroxide improves the antimony decontamination of the treated effluent by a factor of at least 7. Compared with titanium, zirconium has the advantage of being efficacious up to pH values of the order of 10. On the other hand, the use of titanium is more economical.

TABLE II

| Reference of effluent | Treatment | Activity in mCi/m³ $^{106}Ru$ | $^{125}Sb$ | $^{106}Ru$ D.F. | $^{106}Ru$ $R_{eff}$ | $^{125}Sb$ D.F. | $^{125}Sb$ $R_{eff}$ |
|---|---|---|---|---|---|---|---|
| | Untreated | 27 | — | — | — | — | — |
| No 1 | Without Ti | 0.81 | 1.43 | 33 | — | — | — |
| | With Ti | 0.68 | 0.05 | 40 | 1.2 | — | >28 |
| | Untreated | 677 | 47 | — | — | — | — |
| No 2 | Without Ti | 7.4 | 17.9 | 91 | — | 2.6 | — |
| | With Ti | 3.1 | 0.7 | 218 | 2.3 | 67 | 26 |
| | Untreated | 15.3 | 2.7 | — | — | — | — |
| No 3 | Without Ti | 0.18 | 1.2 | 85 | — | 2.3 | — |
| | With Ti | 0.10 | 0.02 | 153 | 1.8 | 135 | 58 |
| | Untreated | 455 | 68.6 | — | — | — | — |
| No 4 | Without Ti | 6.6 | 36.0 | 69 | — | 1.9 | — |
| | With Ti | 4.3 | 0.67 | 105 | 1.5 | 102 | 54 |
| | Untreated | 771 | 57.3 | — | — | — | — |
| | Without Ti | 83 | 41.2 | 9.3 | — | 1.4 | — |
| | With Ti | 20 | 0.64 | 38 | 4 | 89 | 63 |

D. F. : Decontamination factor
$R_{eff}$: Efficiency ratio resulting from addition of titanium.

Examples 1 to 5 which are given below relate to the application of the method in accordance with the invention for decontamination of different elements of the type mentioned in the foregoing. In each example, decontamination of the effluent is carried out in accordance with one of the modes of execution described earlier (acid or basic pH).

Figure 7:
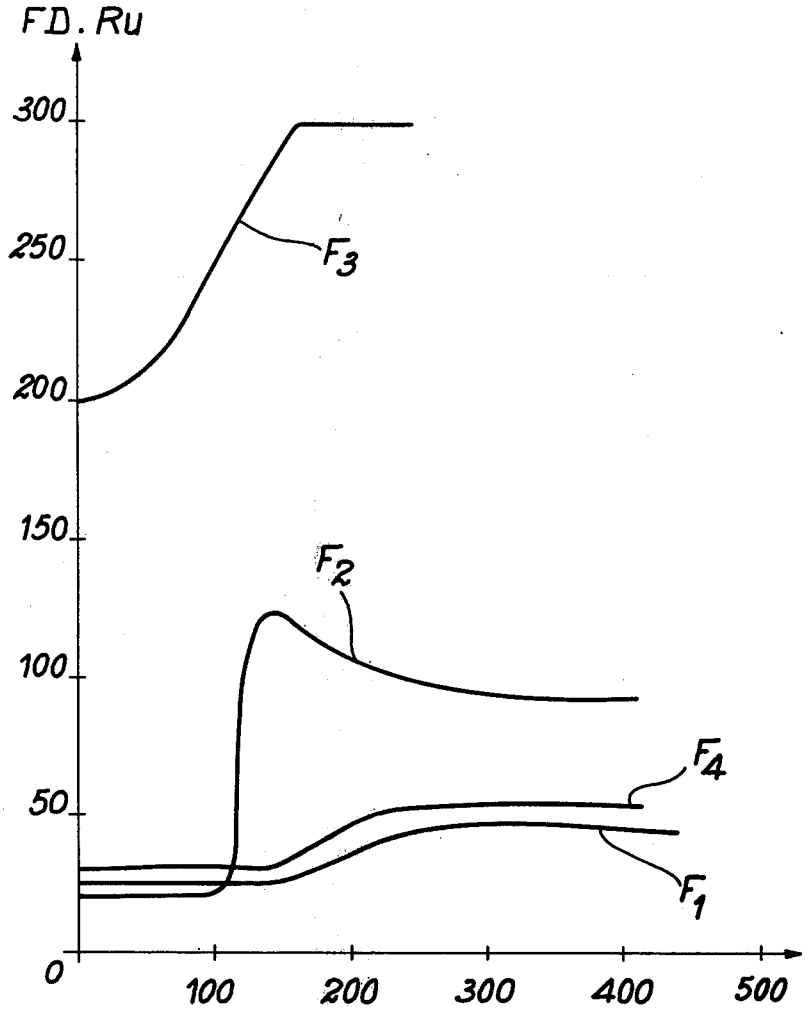

In the case of Examples 1 to 4, reference is made to FIG. 7 which shows the curves $F_1$, $F_2$, $F_3$ and $F_4$ of variation of the ruthenium decontamination factor as a function of the quantity of hydrazine hydrate which is added (mg/l).

Apart from contrary specifications mentioned in the examples, the addition of the reagents listed below is made with the following doses:

sulphuric acid: 12,000 mg/l of sulphate ions, nickel ferrocyanide precipitate: 300 mg/l of ferrocyanide ions and 100 mg/l of nickel ions, ammonium sulphide: 200 mg/l of sulphide ions, cobalt sulphate: 250 mg/l of cobalt ions, barium nitrate: 2000 mg/l of barium ions.

It is pointed out that, in the case of treatment of an effluent at a basic pH value, there is added a quantity of

TABLE I

| Parameters studied: Ti mg/l | final pH | Contacting times (mins) | β D.F. | γ D.F. | $^{106}Ru$ D.F. | $R_{eff}$ | $^{125}Sb$ D.F. | $R_{eff}$ |
|---|---|---|---|---|---|---|---|---|
| Influence of titanium doses | | | | | | | | |
| 0 | 8.5 | 15 | 72 | 23 | 23 | — | 2.3 | — |
| 82 | 8.5 | 15 | 111 | 39 | 29 | 1.3 | 3.5 | 1.5 |
| 165 | 8.5 | 15 | 156 | 55 | 51 | 2.6 | 7 | 3 |
| 250 | 8.5 | 15 | 208 | 85 | 110 | 4.8 | 9.5 | 4.1 |
| 300 | 8.5 | 15 | 244 | 88 | 102 | 4.5 | 17 | 6.7 |
| 350 | 8.5 | 15 | 268 | 100 | 90 | 3.9 | 24 | 10.1 |
| 470 | 8.5 | 15 | 280 | 107 | 117 | 5.0 | 56 | 24.3 |
| 590 | 8.5 | 15 | 270 | 102 | 90 | 3.9 | 50 | 21.8 |
| Influence of contacting time | | | | | | | | |
| 300 | 8.5 | 15 | 244 | 88 | 102 | 4.5 | 17 | 6.7 |
| 300 | 8.5 | 30 | 307 | 102 | 104 | 4.6 | 17 | 6.7 |
| 300 | 8.5 | 60 | 308 | 103 | 103 | 4.5 | 15 | 6.5 |
| 300 | 8.5 | 120 | 270 | 86 | 80 | 3.4 | 13 | 5.6 |
| Influence of final pH | | | | | | | | |
| 300 | 3.5 | 15 | 13 | 50 | 117 | 5.0 | 95 | 41 |
| 300 | 4.5 | 15 | 70 | 84 | 211 | 9.1 | 99 | 43 |
| 300 | 5.5 | 15 | 173 | 106 | 275 | 12.0 | 74 | 32 |
| 300 | 6.5 | 15 | 330 | 120 | 187 | 8.1 | 39 | 16 |
| 300 | 7.5 | 15 | 244 | 96 | 93 | 4.0 | 29 | 12.6 |
| 300 | 8.5 | 15 | 244 | 88 | 102 | 4.5 | 17 | 6.7 |
| 300 | 9.5 | 15 | 82 | 37 | 31 | 1.3 | 8 | 3.5 |
| 300 | 10.5 | 15 | 59 | 30 | 24 | 1.0 | 7 | 3.0 |

D.F. : Decontamination factor
$R_{eff}$: Efficiency ratio resulting from addition of titanium.

sodium hydroxide such that the final pH is of the order of 8.5.

EXAMPLE 1

Treatment of a medium active effluent having the following characteristics:

pH: 0.4;

γ-activity: 6.9 Ci/m³ including 3 of ruthenium-106.

In this effluent, pretreatment with 250 mg/l of hydrazine hydrate associated with an addition of sulphide and cobalt ions at a basic pH value causes the $_{RU}$D.F. to increase from 26 to 45 (see curve $F_1$), namely an improvement in the ruthenium decontamination by a factor of 1.7.

After eight days of ageing resulting from a slow decrease in activity of the effluent and from decomposition of the nitrites, the quantity of hydrazine hydrate which is necessary is finally only 100 mg/l.

In this effluent, the combined effect of the pretreatment and of addition of the sulphide and cobalt ions at an acid pH value makes it possible to obtain a $_{Ru}$D.F. ≃ 250 with a $_{Sb}$D.F. ≃ 13.

EXAMPLE 2

Decontamination of a so-called magnesian effluent resulting from chemical decanning of fuels in a graphite-gas reactor system.

This effluent has the following characteristics:

free acidity: 0.75 N magnesium content: 16.5 g/l

γ-activity: 109 Ci/m³ including 34 of ruthenium-106.

The reagents are added to this effluent in the proportions indicated in the foregoing, except for sulphuric acid which is added in a proportion of 18,000 mg/l of sulphate ions.

Pretreatment with 120 mg/l of hydrazine hydrate (see curve $F_2$) causes an increase in the $_{Ru}$D.F. from 17 to 100, namely an improvement by a factor of 5.8.

EXAMPLE 3

Decontamination of an effluent resulting from the decontamination of extraction banks. This effluent has the following characteristics:

free acidity: 1.8 N

γ-activity: 29 Ci/m³ including 22 of ruthenium-106.

Although the usual treatment at a basic pH value produces a $_{Ru}$D.F. of 200, a pretreatment with 150 mg/l of hydrazine hydrate (see curve $F_3$) brings the $_{Ru}$D.F. to 300. The residual activity is nevertheless due to the ruthenium. A pretreatment followed by a treatment with addition of cobalt and sulphide ions at an acid pH value makes it possible to obtain a $_{Ru}$D.F. ≃ 800.

EXAMPLE 4

Decontamination of a medium active effluent having the following characteristics:

pH: 0.4 proportion of nitrite: 200 mg/l

γ-activity: 15 Ci/m³ including 5 of ruthenium-106.

Pretreatment with 250 mg/l of hydrazine hydrate (see curve $F_4$) produces an increase in the $_{Ru}$D.F. from 30 to 50, namely an improvement by a factor of 1.6 and results in an antimony decontamination factor of 1.5. The residual activity is again caused by ruthenium-106 and antimony-125.

Pretreatment with hydrazine hydrate followed by precipitation of cobalt sulphide in an acid medium (at the initial pH of 0.4) makes it possible to attain a $_{Ru}$D.F. of 200 with a $_{Sb}$D.F. of 16. If in addition, a titanium hydroxide precipitation in an acid medium (pH of 0.4) is carried out by addition of 300 mg/l of titanium ions in the form of titanium sulphate, the $_{Sb}$D.F. attains a value of 300.

EXAMPLE 5

The second preferential arrangement of the method in accordance with the invention has been applied to different samples of effluents designated by the references No. 1, No. 2, No. 3, No. 4, No. 5, by employing an acid solution of titanium sulphate in a quantity such as to have 300 mg of titanium ions per liter of effluent. The results are grouped together in the accompanying Table III. It is apparent from this table that the use of a titanium solution improves the antimony decontamination by a factor within the range of 10 to 60. In the case of ruthenium decontamination, the factor is improved by a factor of 1 to 4.

TABLE III

| Parameters studied | | | D.F. | | | $R_{eff}$ | | |
|---|---|---|---|---|---|---|---|---|
| Zr mg/l | Final pH | Contacting times (mins) | γ | $106_{Ru}$ | $125_{Sb}$ | γ | Ru | Sb |
| Influence of doses of Zr | | | | | | | | |
| 0 | 8.5 | 15 | 11 | 10 | 1.6 | 1 | 1 | 1 |
| 100 | 8.5 | 15 | 13 | 11 | 4.5 | 1.2 | 1.1 | 3 |
| 200 | 8.5 | 15 | 17 | 13 | 20 | 1.5 | 1.3 | 12 |
| 300 | 8.5 | 15 | 23 | 16 | 39 | 2.1 | 1.6 | 24 |
| 400 | 8.5 | 15 | 28 | 18 | 82 | 2.5 | 1.8 | 51 |
| Influence of final pH | | | | | | | | |
| 300 | 3.5 | 15 | 20 | 16 | 41 | | | |
| 300 | 4.5 | 15 | 22 | 32 | 77 | | | |
| 300 | 5.5 | 15 | 22 | 30 | 69 | | | |
| 300 | 6.5 | 15 | 28 | 30 | 66 | | | |
| 300 | 7.5 | 15 | 28 | 24 | 41 | | | |
| 300 | 8.5 | 15 | 23 | 16 | 39 | | | |
| 300 | 9.5 | 15 | 16 | 10 | 29 | | | |
| 300 | 10.5 | 15 | 14 | 8 | 19 | | | |

D.F.: Decontamination factor $R_{eff}$: Efficiency ratio resulting from addition of zirconium

What we claim is:

1. A method of decontamination of a radioactive effluent containing at least ruthenium, of the type in which a certain number of precipitates having absorbent and/or coprecipitant properties with respect to radioactive elements contained in an effluent are formed in said effluent without intermediate phase separation, wherein a reduction of the effluent to be treated is made by the addition to the effluent of hydrazine or of a hydrazine salt and a cobalt sulphide precipitate is then formed in the effluent.

2. A method according to claim 1, wherein the cobalt sulphide precipitate is formed after the pH of the effluent has been adjusted to a value which is higher than 7.

3. A method according to claim 1, wherein the cobalt sulphide precipitate is formed after the pH of the effluent has been adjusted to a value which is lower than 7.

4. A method according to claim 3, wherein the cobalt sulphide precipitate is formed after the pH of the effluent has been adjusted to a value which is lower than 2.

5. A method according to claim 1, wherein precipitates of nickel ferrocyanide, cobalt sulphide and barium sulphate are formed in the effluent to be treated and wherein the sludges thus obtained are then separated-out.

6. A method according to claim 5, wherein said precipitates are formed by successively adding to the effluent to be treated, sulphuric acid, nickel ferrocyanide, sodium hydroxide, ammonium sulphide, a cobalt salt selected from the group consisting of a cobalt nitrate and a cobalt sulphate, and barium nitrate.

7. A method according to claim 5, wherein said precipitates are formed by successively adding to the effluent to be treated, sulphuric acid, nickel ferrocyanide, ammonium sulphide, a cobalt salt selected from the group consisting of a cobalt nitrate and a cobalt sulphate, sodium hydroxide and barium nitrate.

8. A method according to claim 1, wherein 50 to 500 mg/l of hydrazine hydrate or of hydrazine salt are added to the effluent.

9. A method according to claim 1 for decontamination of a radioactive effluent containing at least ruthenium and antimony, wherein there is formed in the effluent to be treated a precipitate of a hydroxide of an element selected from the group consisting of titanium, thorium and zirconium and wherein the sludges thus obtained are separated-out.

10. A method according to claim 9 for the decontamination of a radioactive effluent containing at least ruthenium and antimony, wherein the precipitate of a hydroxide is formed in the effluent to be treated by adding thereto a salt of an element selected from the group consisting of titanium, thorium and zirconium.

11. A method according to claim 10, wherein there are formed in the reduced effluent precipitates of a hydroxide of an element selected from the group consisting of titanium, thorium and zirconium, nickel ferrocyanide, cobalt sulphide and barium sulphate and wherein the sludges thus obtained are then separated-out.

12. A method according to claim 11, wherein said precipitates are formed by successively adding to the effluent to be treated, sulphuric acid, hydrazine or a hydrazine salt, a salt of an element selected from the group consisting of titanium, thorium and zirconium, nickel ferrocyanide, sodium hydroxide, ammonium sulphide, cobalt nitrate or sulphate and barium nitrate.

13. A method according to claim 11, wherein said precipitates are formed by successively adding to the effluent to be treated, sulphuric acid, hydrazine or a hydrazine salt, a salt of an element selected from the group consisting of titanium, thorium and zirconium, nickel ferrocyanide, ammonium sulphide, cobalt nitrate or sulphate, sodium hydroxide and barium nitrate.

14. A method according to claim 11, wherein 50 to 500 mg/l of hydrazine hydrate or hydrazine salt are added to the effluent.

15. A method according to claim 10, wherein the salt of an element is a titanium salt in the form of an aqueous acid solution of titanium sulphate.

16. A method according to claim 15, wherein the aqueous acid solution of titanium sulphate is added in a quantity such as to have 300 mg of titanium ions per liter of effluent to be treated.

17. A method according to claim 10, wherein the salt of an element is a zirconium salt in the form of zirconyl nitrate solution.

18. A method according to claim 17, wherein the zirconyl nitrate solution is added in a quantity such as to have 400 mg of zirconium ions per liter of effluent to be treated.

19. A method according to claim 9, wherein there are formed in the effluent to be treated, precipitates of a hydroxide of an element selected from the group consisting of titanium, thorium and zirconium, nickel ferrocyanide, cobalt sulphide and barium sulphate, and wherein the sludges thus obtained are separated-out.

20. A method according to claim 19, wherein said precipitates are formed by successively adding to the effluent to be treated, sulphuric acid, a salt of an element selected from the group consisting of titanium, thorium and zirconium, nickel ferrocyanide, sodium hydroxide, ammonium sulphide, a cobalt salt selected from the group consisting of a cobalt nitrate and a cobalt sulphate and barrium nitrate.

21. A method according to claim 19, wherein said precipitates are formed by successively adding to the effluent to be treated, sulphuric acid, a salt of an element selected from the group consisting of titanium, thorium and zirconium, nickel ferrocyanide, ammonium sulphide, a cobalt salt selected from the group consisting of a cobalt nitrate and a cobalt sulphate, sodium hydroxide and barium nitrate.

* * * * *